US006634919B2

(12) United States Patent
Gordon et al.

(10) Patent No.: US 6,634,919 B2
(45) Date of Patent: Oct. 21, 2003

(54) PACIFIER TOY

(76) Inventors: James Gordon, 2257 Parkwood Blvd., Eureka, CA (US) 95503; Tama Ferrell, 210 Wall St., Seymour, IA (US) 52590

( * ) Notice: Subject to any disclaimer, the term of this patent is extended or adjusted under 35 U.S.C. 154(b) by 0 days.

(21) Appl. No.: 09/803,491

(22) Filed: Mar. 12, 2001

(65) Prior Publication Data

US 2002/0127943 A1 Sep. 12, 2002

(51) Int. Cl.[7] ..... A63H 3/00; A61J 17/00

(52) U.S. Cl. ..... 446/73; 446/72; 446/391; 606/234

(58) Field of Search ..... 446/72, 73, 390, 446/391; D24/195; 606/234

(56) References Cited

U.S. PATENT DOCUMENTS 2,860,639 A * 11/1958 Hoover ..... 606/234
3,442,267 A * 5/1969 Krygier ..... 128/879
4,277,910 A * 7/1981 Kramer ..... 446/390
D351,232 S * 10/1994 Spence, Jr. ..... D24/195
D359,123 S * 6/1995 Perrine ..... D24/194
D409,755 S * 5/1999 Thorpe et al. ..... D24/195
6,299,501 B1 * 10/2001 Lynch ..... 446/73

* cited by examiner

*Primary Examiner*—Derris H. Banks
*Assistant Examiner*—Dmitry Suhol
(74) *Attorney, Agent, or Firm*—Gregory Smith & Associates; Carol D. Titus

(57) ABSTRACT

Pacifier Toy with a pacifier having a rigid plastic plate and an integral resilient, centrally located nipple, and a holding ring, a child's toy having an animal shape where the face portion of the animal is framed so that it can receive the pacifier, the pacifier having eyes and mouth features painted on or otherwise affixed, the pacifier having the nipple that acts as the nose portion of the animal's face, and the face frame of the animal toy capable of removably retaining said rigid plastic pacifier plate so that a child can use said pacifier by itself or in conjunction with said toy animal.

16 Claims, 3 Drawing Sheets

PACIFIER TOY

BACKGROUND OF THE INVENTION

This invention relates generally to the field of children's toys, and more particularly to a pacifier toy.

Pacifiers are known. They tend to be comprised of a rigid plastic plate having a centrally located resilient nipple. Usually a holding ring is attached to the back portion of the plastic plate. Parents give pacifiers to children ranging from new borns to four or five years old so that the child can enjoy the sucking effect that is associated with sucking on a mothers breast or a baby bottle. This tends to calm and pacify a baby, hence the term pacifier.

Pacifier designs tend to be relatively similar because the function of the pacifier plays a major role in the shape, namely a flat plate that presses up against and around the babies mouth area and an attached nipple that goes into the babies mouth. Some variation can be found in the size of the plastic plate and the size and shape of the nipple.

Although currently available pacifiers are serviceable, there has been no attempt to incorporate a child's pacifier into a child's toy so that the pacifier becomes the face or other anatomical portion of a toy animal and can thereby serve a dual purpose.

SUMMARY OF THE INVENTION

The primary object of the invention is to provide a pacifier toy that can be used as a standard pacifier as well a have additional play benefits as a child's toy.

Another object of the invention is to provide a pacifier toy that uses the plastic shield portion and nipple portion as an anatomical feature of a person or animal.

Other objects and advantages of the present invention will become apparent from the following descriptions, taken in connection with the accompanying drawings, wherein, by way of illustration and example, an embodiment of the present invention is disclosed.

Pacifier Toy comprising: A pacifier having a rigid plastic plate and an integral resilient, centrally located nipple, and a holding ring, a child's toy having an animal shape where the face portion of said animal is framed so that it can receive said pacifier, said pacifier having eyes and mouth features painted on or otherwise affixed, said pacifier having said nipple that acts as the nose portion of said animal's face, and said face frame of said animal toy capable of removably retaining said rigid plastic pacifier plate so that a child can use said pacifier by itself or in conjunction with said toy animal.

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
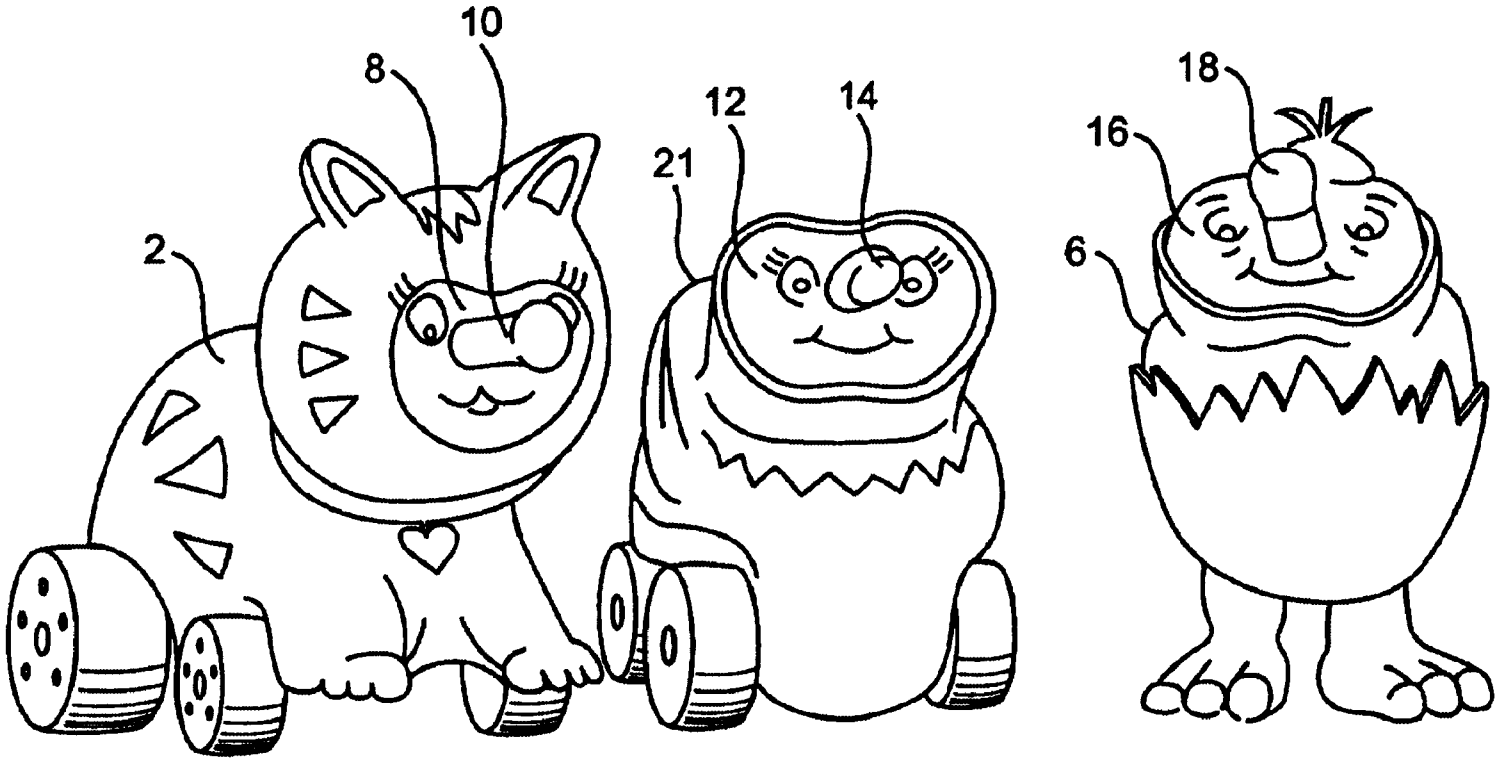
FIG. 1 is a perspective view of three pacifier toys of the present invention
Figure 2:
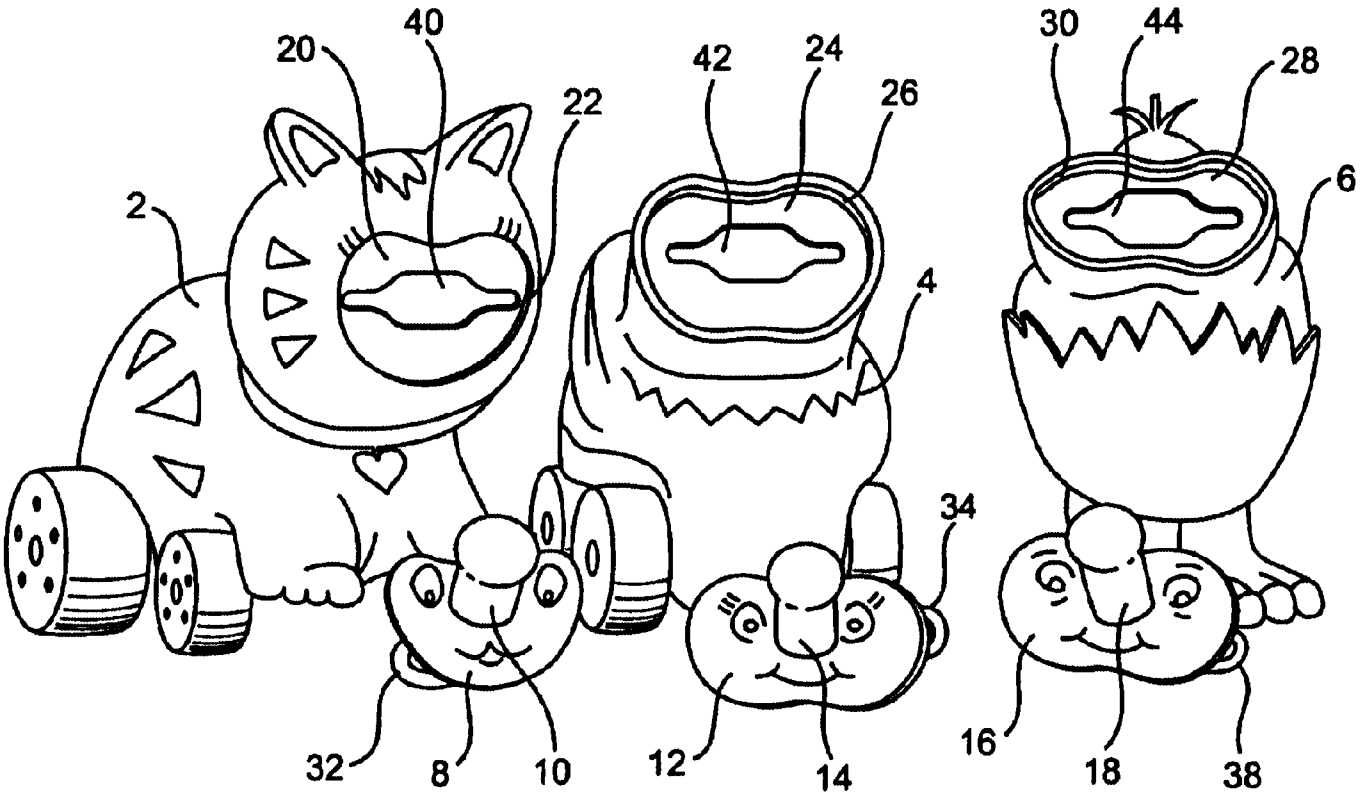
FIG. 2 is a perspective view of three pacifier toys with the pacifiers removed
Figure 3:
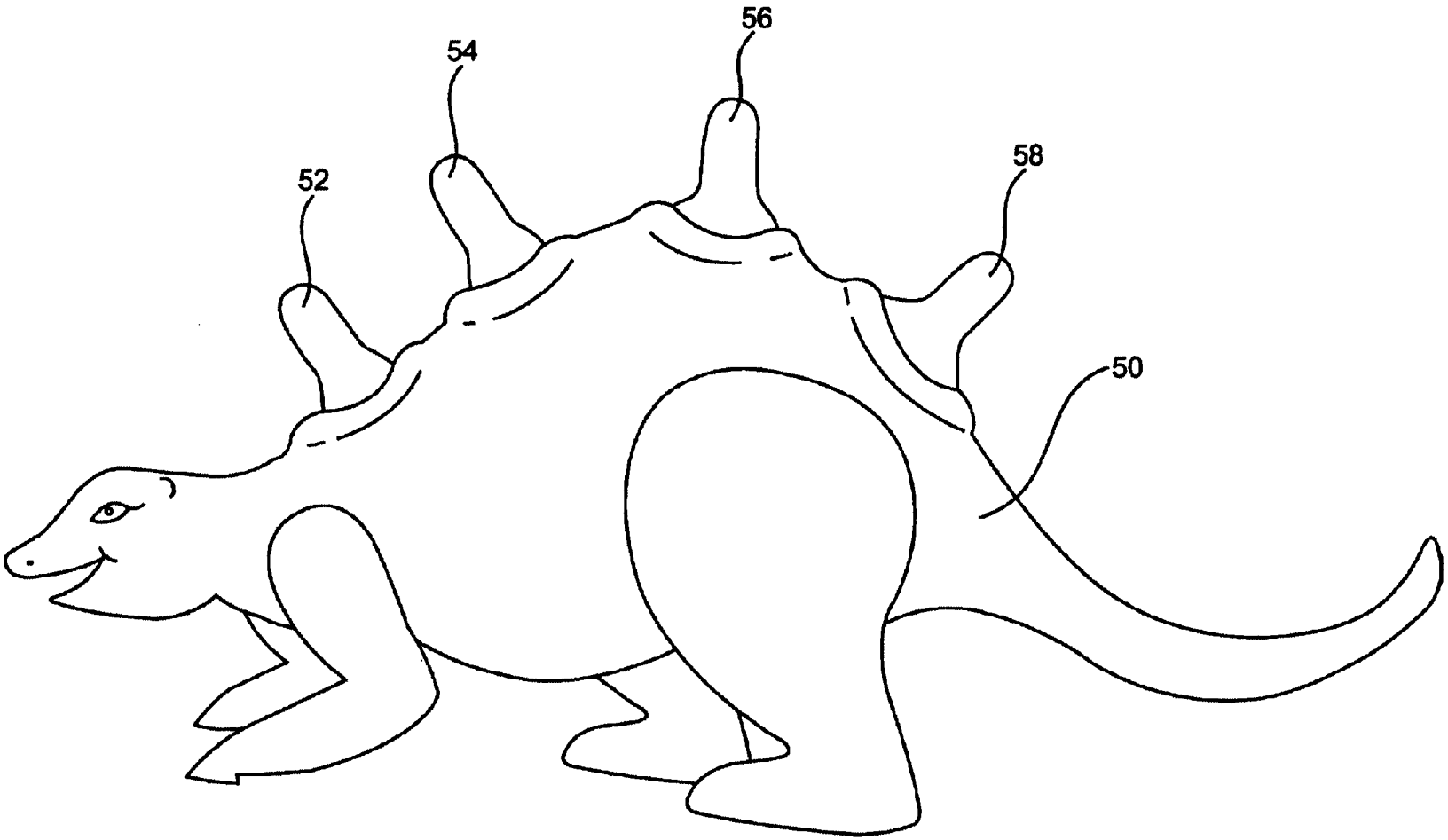
FIG. 3 is a side view of a pacifier toy.

Referring now to FIG. 1 we see a perspective view of three pacifier toys 2, 4, 6, of the present invention. In the preferred embodiment the pacifiers 8, 12, 16 represent the faces of the animals, a cat 2, a duck-like animal 4, and a baby chick 6. A child can hold the toy and suck on the nipple 10, 14, 18 which represents the toy animal's nose. FIG. 2 shows the pacifiers 8, 12, 16 removed from the bodies of the animal toys 2, 4, 6. Each toys face portion has a frame 22, 26, 30 and a flat recessed portion 20, 24, 28 that can receive respective pacifiers 8, 12, 16. Each flat recessed portion 20, 24, 28 has an aperture 40, 42, 44 that allows room for the pacifier's holding ring 30, 32, 38. The frame portions 22, 26, 30 are sized so that the pacifiers 8, 12, 16 can snap into the frame portions and can be easily removed by pulling on the nipple portion of the pacifier. FIG, 3 shows an alternate embodiment where the pacifiers 52, 54, 56, 58 represent the scales of a toy dinosaur's 50 back.

In the above described and illustrated way the pacifier to of the present invention uses a standard pacifier as an anatomical component of a toy animal such as a face or scales of a dinosaur. The pacifiers can also be used as feet or arms or a tail. In this way a child can derive pleasure and comfort from a toy and a pacifier at the same time. The pacifier can be easily removed and replaced as needed.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A pacifier toy, comprising:

a toy having the appearance of a body and a head of an animal, said toy including:

an aperture located in said head of said animal, a pacifier depicting a face of said animal, a plastic shield having a front surface and a back surface, a depiction of eyes o said front surface of said plastic shield, a nipple extending from said front surface of said plastic shield, said nipple located to simulate a nose of said face, and a holding ring extending from a back surface of said plastic shield, said holding ring sized and configured to be removably held within said aperture, wherein, when said holding ring a placed into said aperture, said pacifier forms said face of said animal.

2. The pacifier toy o claim 1, further comprising a generally flat recessed portion located on said head of said animal, and wherein said aperture is located in said recessed portion.

3. The pacifier toy of claim 2, further comprising a frame located around said recessed portion.

4. The pacifier toy of claim 1, further comprising a depiction of a mouth located on said front surface of said plastic shield.

5. The pacifier toy of claim 1, wherein said pacifier forms the entire face portion of said animal.

6. The pacifier toy of claim 5, wherein said face consists of said eyes, said nipple and a mouth located on said front of said plastic shield.

7. The pacifier toy of claim 1, wherein said plastic shield is generally rigid.

8. The pacifier toy of claim 1, wherein said nipple is centrally located on said plastic shield.

9. The pacifier toy of claim 1, wherein said depiction of said eyes is painted on said plastic shield.

10. The pacifier toy of claim 1, wherein said pacifier is removable from said toy by pulling on said nipple.

11. A pacifier toy, comprising:

a toy having the appearance of a body and a head of an animal, said toy including:

a generally flat recess d portion located on said head of said animal, a frame surrounding said recessed portion, and an aperture locate in said recessed portion, a pacifier depicting a face of aid animal, a plastic shield having front surface and a back surface, depictions of eyes and mouth of said face on said front surface of said plastic shield, a nipple extending to said front surface of said plastic shield, said nipple located to simulate a nose o said face, and a holding ring extending from a back surface of said plastic shield, said holding ring sized and configured to be removably held within said aperture, wherein, when said holding ring is placed into said aperture, said pacifier forms said face of said animal.

12. The pacifier toy of claim 11, wherein said pacifier forms the entire face portion of said animal.

13. The pacifier toy of claim 12, wherein said face consists of said eyes, said nipple and said mouth located on said front of said plastic shield.

14. The pacifier toy of claim 11, wherein said plastic shield is generally rigid.

15. The pacifier toy of claim 11, wherein said nipple is centrally located on said plastic shield.

16. The pacifier toy of claim 11, wherein said depiction of said eyes and said mouth is painted on said plastic shield.

* * * * *